United States Patent [19]

Poplawski

[11] 3,987,526

[45] Oct. 26, 1976

[54] FAIRLEAD ROLLER ASSEMBLY

[75] Inventor: Eugene M. Poplawski, Aurora, Ill.

[73] Assignee: Caterpillar Tractor Co., Peoria, Ill.

[22] Filed: May 12, 1975

[21] Appl. No.: 576,514

[52] U.S. Cl. ..... 29/116 R

[51] Int. Cl.[2] ..... B21B 13/02

[58] Field of Search ..... 29/116 R, 123

[56] References Cited

UNITED STATES PATENTS

| | | | |
|---|---|---|---|
| 1,946,024 | 2/1934 | Lamatsch | 29/116 R X |
| 2,270,436 | 1/1942 | Hart | 29/116 R |
| 3,097,022 | 7/1963 | Sernetz | 29/116 R |
| 3,138,848 | 6/1964 | Cheney | 29/123 |
| 3,566,497 | 3/1971 | Hamlen | 29/123 |
| 3,748,711 | 7/1973 | Smith | 29/116 R |
| 3,837,553 | 9/1974 | Bock | 29/116 R X |

*Primary Examiner*—Alfred R. Guest

*Attorney, Agent, or Firm*—Wegner, Stellman, McCord, Wiles & Wood

[57] ABSTRACT

An improved fairlead roller assembly wherein the wear portion is removably installed to permit facilitated maintenance and replacement. The wear portion of the assembly is defined by a tubular element which is captured endwise between improved end members and removably secured thereto by readily removable securing structure.

9 Claims, 2 Drawing Figures

FAIRLEAD ROLLER ASSEMBLY

BACKGROUND OF THE INVENTION

1. Field of the Invention

This invention relates to roller assemblies and in particular to fairlead roller assemblies.

2. Description of the Prior Art

Fairlead rollers are utilized for guiding cables and the like where substantial forces may be applied to the cable. Illustratively, fairlead rollers are utilized in connection with motorized log skidders and arches in the lumbering industry wherein cables are utilized for moving heavy logs and the like.

Under the highly erratic and variable load conditions in such use, shifting of the cables on the fairlead roller causes substantial wear of the roller surface as by chafing and abrading thereof. In turn, the roughening of the roller surface tends to cause wear of the cable, often causing premature failure thereof.

One improved form of fairlead roller assembly is shown in U.S. Pat. No. 3,748,711 of Duane R. Smith, which patent is owned by the assignee hereof. Therein, a lubricated roller assembly is disclosed having improved means for lubricating the roller including an oil chamber formed within a hub, and seal means outwardly of the bearings between the shaft and roller for retaining the oil. The roller assembly is moved between a pair of spaced support plates and is secured in a desired position therebetween by trunnion caps mounted in aligned bores in the spaced support plates. The roller hub is carried on the roller bearings and is centered therebetween by the roller mounting means engaging the bearings.

SUMMARY OF THE INVENTION

The present invention comprehends an improved roller assembly which is adapted to be used as a fairlead roller and which includes improved means for facilitated servicing thereof.

More specifically, the invention comprehends providing a portion of the roller normally receiving the greatest wear in the use of the assembly with improved hardened characteristics. The invention comprehends the provision of the wear area portion of the roller as a separable portion which is readily removed and installed in the assembly permitting facilitated maintenance thereof. As only the wear portion of the roller need be replaced, a substantial saving in the maintenance operation is further effected.

The assembly is arranged for facilitated removal from the structural support means, such as logging arch structural plates.

The roller may comprise a right circularly cylindrical wear portion, or alternatively, may comprise a concave portion adapted to guide the cable into a preselected recessed portion thereof.

The wear portion may be secured to separable end members by readily removable securing means. In the illustrated embodiment, the securing means comprises threaded means and more specifically, may comprise bolts extending through the end members into threaded engagement with the opposite ends of the roller wear portion.

As the roller wear portion comprises a generally tubular element, it may be readily hardened to a preselected depth without weakening of the supporting end members.

Thus, the roller assembly of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. I is a side elevation partially in diametric section of a roller assembly embodying the invention; and FIG. II is a view similar to that of FIG. I but showing a modified form of roller assembly embodying the invention.

DESCRIPTION OF THE PREFERRED EMBODIMENT

Figure 1:
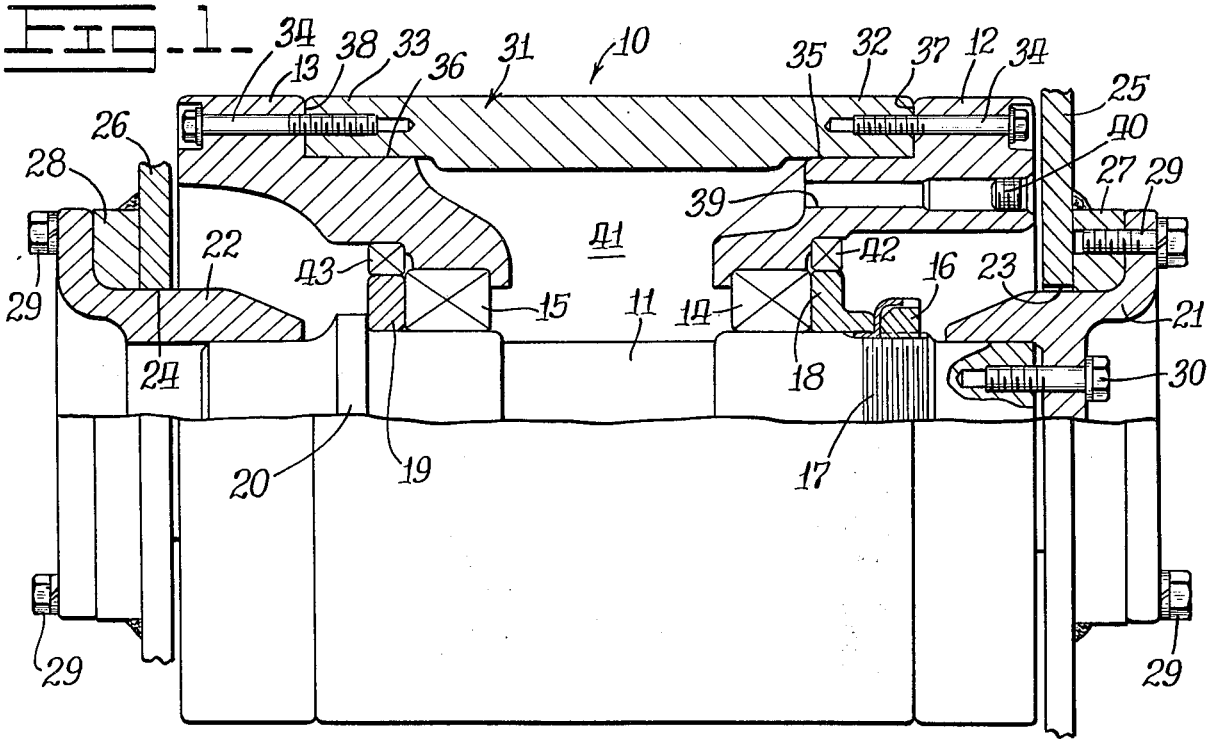

In the exemplary embodiment of the invention as disclosed in FIG. I of the drawing, a roller assembly generally designated 10 is shown to comprise a shaft 11, a pair of end members 12 and 13, and a pair of bearings 14 and 15 for rotatably supporting the end members 12 and 13, respectively, coaxially rotatably on shaft 11.

The bearings may be preloaded on shaft 11 by means of a threaded collar 16 threadedly mounted to a male threaded portion 17 on shaft 11 and a pair of thrust collars 18 and 19 slidably fitted on the shaft. The shaft further defines an annular shoulder 20 disposed to be abutted by collar 19 which is preselected to effect desirable centered positioning of the assembly as will be brought out more fully hereinafter.

Shaft 11 is secured to a pair of end caps 21 and 22 received in suitable openings 23 and 24 in a pair of spaced structural plates 25 and 26 which, illustratively, may comprise the side walls of a grapple boom or logging arch (not shown). As shown in FIG. I, the end caps 21 and 22 may be threadedly secured to annular portions 27 and 28 fixed to the structural plates 25 and 26, respectively, by suitable bolts 29. The shaft may be secured to end cap 21 by suitable bolts 30.

The roller assembly further includes a drum, or casing, 31 which defines the wear portion of the assembly. As shown in FIG. I, the drum may comprise a right circularly cylindrical tubular member having opposite end portions 32 and 33 removably secured respectively to the end members 12 and 13 by bolts 34. The end members define annular, radially outwardly facing shoulders 35 and 36, respectively, and radial axially opposed shoulders 37 and 38, respectively. The end portions 32 and 33 of the drum slidably fit about annular shoulders 35 and 36 and are abutted by the end shoulders 37 and 38 upon the tightening of the bolts 34 to removably secure the drum and end members in assembled relationship, as shown in FIG. I.

Lubrication of the roller assembly is effected through an inlet port 39 in end member 12 which may be closed by a suitable screw 40 after suitable lubricating material is introduced into the chamber 41 between the end members inwardly of the bearings 14 and 15. Suitable seals 42 and 43 may be provided for sealing the chamber 41 against the loss of lubricant therefrom.

Thus, in the event that the outer surface of the drum 31 becomes worn, the replacement thereof may be readily effected by simply firstly removing the end caps 21 and 22 from the structural plates 25 and 26 and releasing shaft 11 from end cap 21 by removal of bolts 30, whereupon the assembly may be moved transaxially outwardly from between the structural plates 25 and 26. Drum 31 may then be removed simply by withdrawal of the bolts 34 and the removal of end member 12 coaxially to the right, as seen in FIG. I, from shaft 11. This permits the drum 31 to be moved coaxially to the right, as seen in FIG. I, from the end member 13 and from the assembly by withdrawal beyond the righthand end of shaft 11.

A replacement drum may be readily installed by a reverse procedure wherein the lefthand end of the drum is slid on shoulder 36 into abutment with shoulder 38 coaxially of shaft 11. End member 12 is then brought into endwise association with the righthand end of the drum and bearing 14, seal 42, thrust collar 18, and preloading collar 16 are then reinstalled to lock the assembly in preloaded centered association on the shaft.

The thusly assembled structure is then moved transaxially between the structural plates 25 and 26 into alignment with the openings 23 and 24 therein and the end caps 21 and 22 reinstalled by means of bolts 29 and 30 to complete the assembly as seen in FIG. I.

Suitable lubricant may be re-introduced into chamber 41 whereupon the assembly is again ready for cable leading service.

Figure 2:
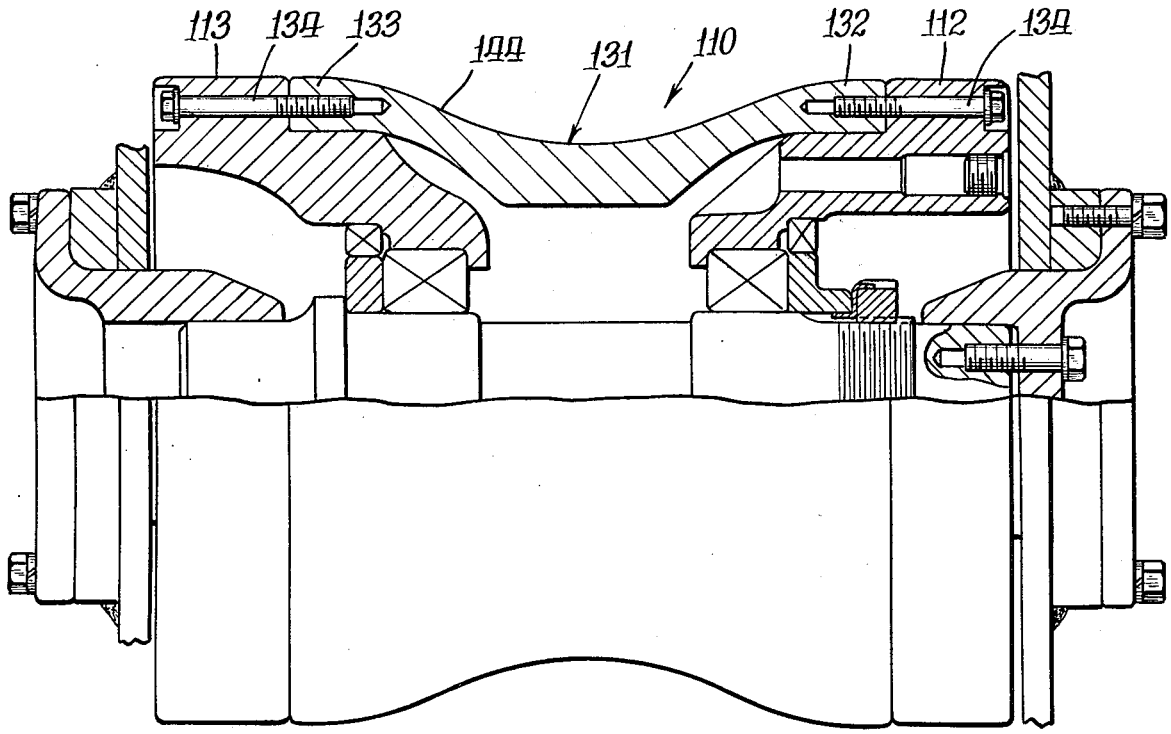

Referring now to FIG. 2, a modified form generally designated 110 of roller assembly generally similar to roller assembly 10 of FIG. I is shown to comprise an assembly identical to the assembly 10 except for a modified form of drum 131 which is provided with a concave annular outer wear surface 144 which is adapted to guide the cable into the recess portion thereof for further effective minimizing of wear of the cables. End portions 132 and 133 of drum 131 are secured to the end members 112 and 113 by bolts 134 in the same manner as in the embodiment of FIG. I.

Roller assembly 110 is similar in all other respects and functions similarly in all other respects to roller assembly 10 and similar elements thereof are identified by similar reference numerals but 100 higher.

In each form, the drum may be formed of steel or similar rigid tubing which may have optimum wear characteristics for the desired service.

The use of the removable securing means for securing the drum to the end members provides substantially improved facilitated maintenance and provides extended useful life of the cables by effectively minimizing chafing and abrading thereof by a worn drum surface. The drum is readily removed when desired while yet the securing means effectively positively retain the drum in assembled relationship during the useful life of the assembly.

The foregoing disclosure of specific embodiments is illustrative of the broad inventive concepts comprehended by the invention.

What is claimed is:

1. A roller assembly comprising: shaft means having an annular shoulder; first and second annular end members defining mounting portions; first and second bearing means for rotatably mounting said end members respectively in coaxial, spaced relationship on said shaft means, said first bearing means abutting said shoulder and said second bearing means being axially adjustably positionable on said shaft means; a tubular drum member coaxially of said shaft means and having opposite end portions; securing means removably securing said drum member end portions to said end member mounting portions; and adjustable positioning means on said shaft means urging said second bearing means, said second end member, said drum member, and said first end member as a unit against said first bearing means to urge said first bearing means against said shoulder with an adjustable preload force and said second bearing means against said second end member with an equal preload force.

2. The roller assembly of claim 1 wherein said drum member defines a right circularly cylindrical outer wear surface.

3. The roller assembly of claim 1 wherein said drum member defines a concave annular outer wear surface.

4. The roller assembly of claim 1 wherein said drum member defines an outer wear portion extending fully from end to end thereof.

5. The roller assembly of claim 1 wherein said securing means comprises threaded means.

6. The roller assembly of claim 1 wherein said securing means comprise bolts extending through said end member annular portions and threaded to said drum member end portions.

7. The roller assembly of claim 1 wherein said positioning means comprises means adjustably threaded to said shaft means.

8. The roller assembly of claim 1 wherein said second bearing means includes a thrust collar engaged by said positioning means.

9. The roller assembly of claim 1 wherein said first bearing means includes a thrust collar engaging said shoulder.

* * * * *